US005230294A

United States Patent [19]

Klein

[11] Patent Number: 5,230,294

[45] Date of Patent: Jul. 27, 1993

[54] ENDLESS BELT ZIPPER FEED WITH SENSORS FOR A SEWING MACHINE

[75] Inventor: Michael Klein, Bielefeld, Fed. Rep. of Germany

[73] Assignee: Durkopp Adler Aktiengesellschaft, Fed. Rep. of Germany

[21] Appl. No.: 880,750

[22] Filed: May 8, 1992

[30] Foreign Application Priority Data

Jun. 1, 1991 [DE] Fed. Rep. of Germany ..... 4118017

[51] Int. Cl.[5] ..... D05B 3/20; D05B 27/10; D05B 35/06

[52] U.S. Cl. ..... 112/113; 112/115; 112/152; 112/322; 112/265.2

[58] Field of Search ..... 112/104, 113, 114, 115, 112/121.15, 136, 152, 236, 265.1, 265.2, 303, 121.27, 272

[56] References Cited

U.S. PATENT DOCUMENTS

| | | | |
|---|---|---|---|
| 2,329,991 | 9/1943 | Kellum | 112/136 |
| 2,891,495 | 6/1959 | Porter | 112/152 |
| 3,608,506 | 9/1971 | Glindmeyer | 112/105 |
| 4,362,116 | 12/1982 | Sen Gupta et al. | 112/113 X |
| 4,576,104 | 3/1986 | Miyakawa | 112/265.2 |
| 4,611,546 | 9/1986 | Miyakawa | 112/113 X |
| 4,630,364 | 12/1986 | Fyfe et al. | 112/104 X |
| 4,658,740 | 4/1987 | Goldbeck | 112/114 |
| 4,714,038 | 12/1987 | Boser | 112/265.2 |
| 4,979,450 | 12/1990 | Dudek et al. | 112/113 X |
| 5,016,549 | 5/1991 | Sadlack et al. | 112/113 X |
| 5,029,543 | 7/1991 | Trojan | 112/303 X |
| 5,067,424 | 11/1991 | Ishikawa et al. | 112/104 X |

FOREIGN PATENT DOCUMENTS 3902932 10/1990 Fed. Rep. of Germany ... 112/265.2

*Primary Examiner*—Clifford C. Crowder
*Assistant Examiner*—Ismael Izaguirre
*Attorney, Agent, or Firm*—Laff, Whitesel, Conte & Saret

[57] ABSTRACT

A zip-fastener feeding device for an automatic sewing unit comprises an introduction device, an endless drawing means guided via a drive wheel and via deflection pulleys and a guiding device. Zip fasteners can be introduced through the introduction device by means of the drawing means by at least one guiding channel of the guiding device onto a workpiece retaining plate or a zip-fastener retainer provided in the latter and these zip fasteners can be precisely positioned there.

18 Claims, 7 Drawing Sheets

FIG. 8
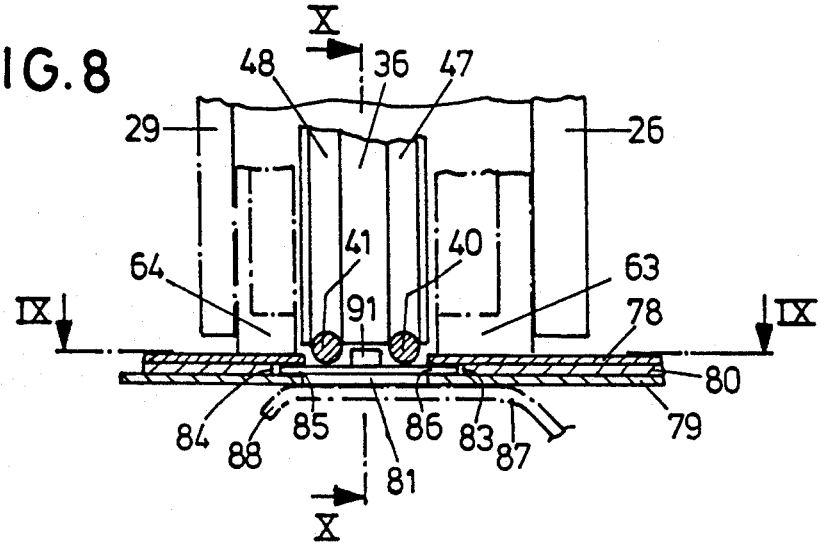
FIG. 9
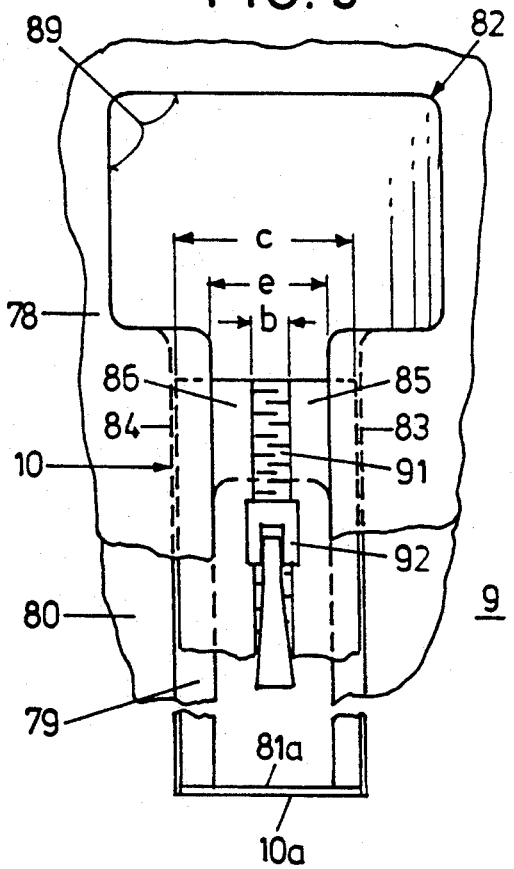
FIG. 10
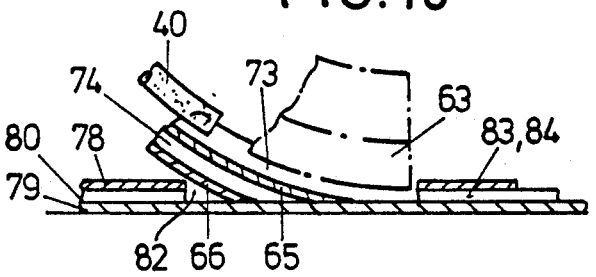
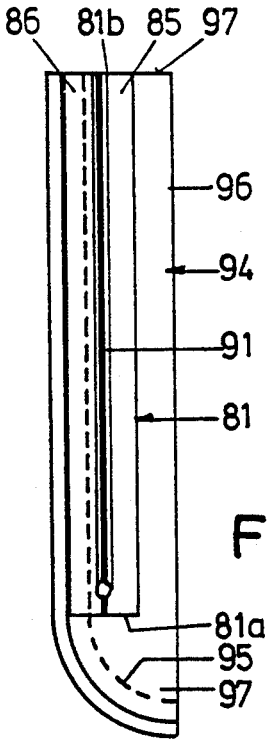
FIG. 11

ENDLESS BELT ZIPPER FEED WITH SENSORS FOR A SEWING MACHINE

BACKGROUND OF THE INVENTION

1. Field of the Invention

The invention relates to a zip-fastener feeding device for an automatic sewing unit.

2. Background Art

From U.S. Pat. No. 4,658,740 an apparatus is known, in which a zip fastener to be sewn is seized on the entire surface by a gripping device and is transported from an insertion position to a position which is defined exactly in relation to a part of workpiece. The precise positioning of the zip fastener has to be performed even when manually bearing the zip fastener on the insertion position, which is time-consuming and which requires a certain dexterity of the operator. Further it is necessary in this case that the zip fastener to be fed is nontwisting and is available with ends, which are located parallel to each other.

From U.S. Pat. No. 2,329,991 an apparatus is known by means of which a zip fastener is fed to a sewing station of a sewing machine. To this effect a guide channel precedes the sewing station, into which guide channel the zip fastener is continuously fed manually by the operator. An accurate positioning of the zip fastener before sewing in relation to a workpiece is not possible by means of this, as the feeding of the zip fastener and its positioning in relation to the workpiece is performed progressively during the sewing process.

From U.S. Pat. No. 3,608,508 it is known to insert a zip fastener and a part of workpiece into a workpiece holder and to position them herein in relation to each other. Feeding of the zip fastener to the workpiece holder and positioning is performed manually.

From U.S. Pat. No. 4,714,038 it is known to feed a zip fastener through a guide channel to a sewing station of a sewing machine. Also in this case positioning of the zip fastener in relation to the part of workpiece is performed continuously during sewing at the workpiece station.

SUMMARY OF THE INVENTION

It is an object of the invention to create a zip-fastener feeding device for an automatic sewing unit, by means of which a time-saving feeding of zip fasteners to a sewing position is possible, without requiring special demands to the dexterity of the operator.

This object is attained according to the invention, by providing an introduction device for a zip fastener, an endless drawing means for a zip fastener drivable in a transport direction, a controllable drive for the drawing means, an output section for the zip fastener, and a detection device associated to the output section for detecting an end position of the zip fastener and for putting out of function the drawing means. By means of the measures according to the invention it is attained that the zip fastener is introduced in aligned manner and then in this aligned position is transported by a drawing means, and that in the output section it is set down in a defined accurate position by putting out of function the drawing means. This means that it can be positioned accurately in relation to another part of workpiece. Due to the fact that the drawing means is formed endlessly, i.e. in rotating manner, idle runs are lacking, as they occur otherwise with reversing drives, such as pneumatic drives.

Because, according to an advantageous embodiment the introduction device comprises lateral introduction surfaces, the zip fastener is laterally aligned in the introduction device. The further embodiment, according to which the drawing means comprises two endless belts which are arranged parallel and at a distance to each other, results in that the teeth of the zip fastener are transported between the belts, so that these abut on the halves of the zip fastener. The further improvement, in which the drawing means is supported transversely to the transport direction between the introduction device and the output section by at least one supporting rail, has the effect that the drawing means cannot turn off transversely to the transport direction, by means of which an accurate guidance and an accurate transport of the zip fastener is assured. This applies in particular to the measures according to which a supporting rail for the drawing means is provided above the output section, by means of which measures the zip fastener is transported accurately between the retainer and the supporting rail by the drawing means. For a supporting rail preceding the output section the measures, in which a presser bar is provided in transport direction behind the introduction device and before the output section, which presser bar presses a zip fastener against the drawing means, are advantageous for the same purpose.

If a guiding device precedes the output section, which guiding device comprises a guiding channel for a zip fastener, into which the drawing means protrudes at least partially and which opens towards the output section, it is assured that the zip fastener is accurately transported, in particular by means of the drive wheel, and is introduced to a workpiece retaining plate or a zip-fastener retainer.

If the guiding device comprises an additional outer guiding channel facing away from the drawing means and if on one side of the drawing means a deflector is provided, which guides into the additional outer guiding channel, it becomes possible to feed not only simple zip fasteners, but also zip fasteners provided already with a covering strip. The covering strip is guided into the outer guiding channel by the deflector, which makes it possible to feed the covering strip to a zip-fastener retainer separately from the adjacent half of the zip fastener, so that a subsequent sewing process is possible, in which the covering strip is not sewn together.

If a detection device for detecting a zip fastener and for putting into function the controllable drive is associated to the introduction device, it is attained that the drawing means is put into operation only with the introduction of the zip fastener into the feeding device. The further embodiment, in which the zip-fastener feeding device is tiltably supported in a bearing by means of a tilting drive, makes it possible to move the feeding device out of the working area of the sewing machine after the feeding of a zip fastener.

Further advantages and features of the invention will become apparent from the ensuing description of one example of embodiment taken in conjunction with the drawing.

BRIEF DESCRIPTION OF THE DRAWINGS

FIG. 8 shows a part section through the zip-fastener feeding device in accordance with the line VIII—VIII in FIG. 4, FIG. 9 shows a plan view onto a zip-fastener retainer in accordance with the line IX—IX in FIG. 8, FIG. 10 shows a vertical part section through FIG. 8 in accordance with the line X—X in FIG. 8, FIG. 11 shows a zip fastener with a lower covering strip sewn to the zip fastener.

DESCRIPTION OF THE PREFERRED EMBODIMENTS

Figure 1:
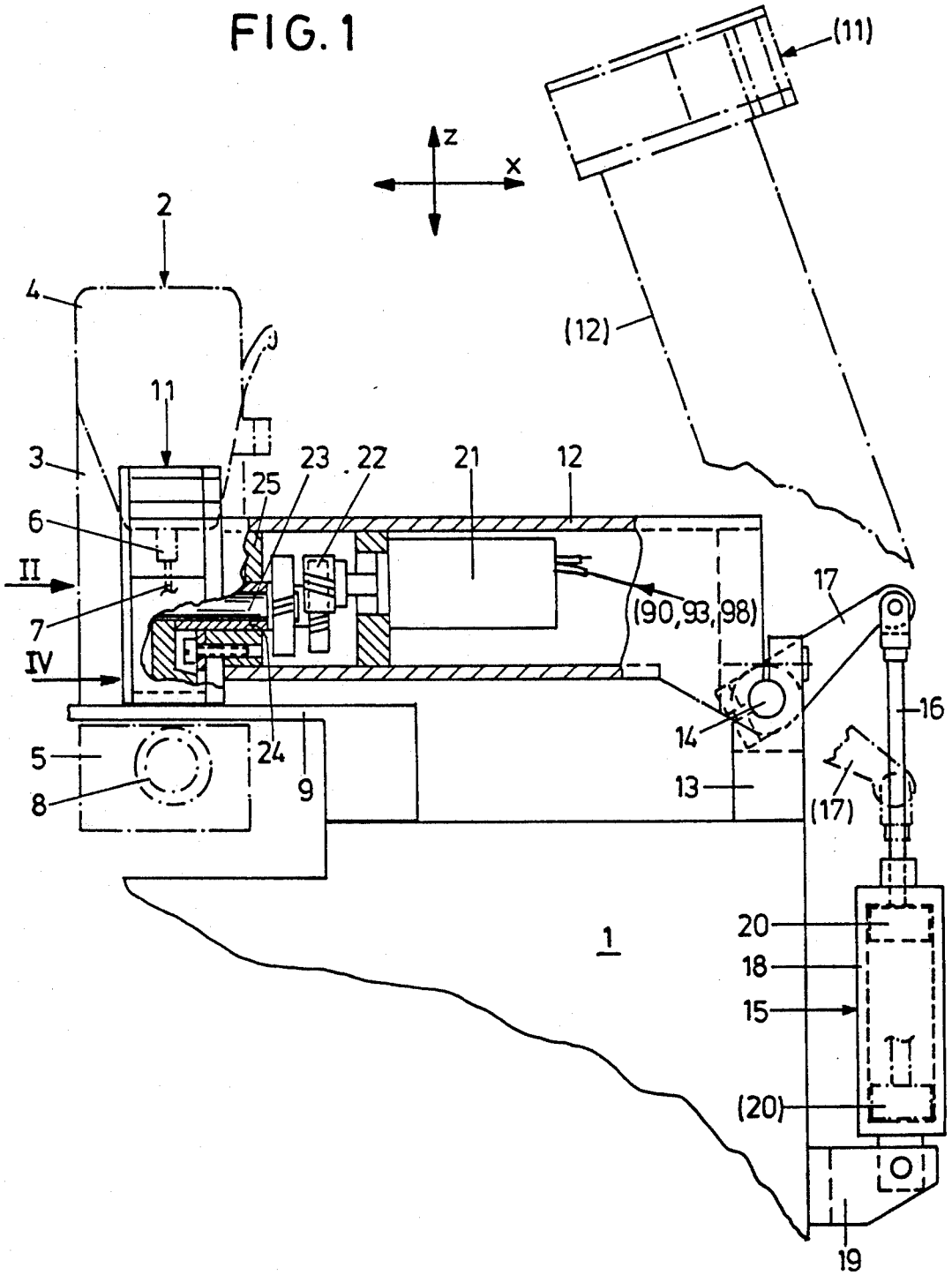
FIG. 1 shows a partial front view of an automatic sewing unit with a zip-fastener feeding device.

An automatic sewing unit only outlined in the drawing comprises a stand 1, onto which a sewing machine 2 is arranged. The sewing machine 2 is arranged on an x-y carriage (not shown) for displacement on a horizontal x-y plane. The sewing machine 2 comprises a vertical standard 3, from which an upper arm 4 and a lower arm 5, which is also designed as base plate, extend away horizontally. In the upper arm 4 a needle bar 6 with a needle 7 is supported vertically and drivable in z-direction. A looper 8 is associated to the needle 7 in the lower arm 5. Needle 7 and looper 8 form in usual manner stitch forming instruments. At the upper side of the lower arm 5 a workpiece retaining plate 9 is arranged, which comprises a zip-fastener retainer 10. The workpiece retaining plate 9 is secured to the stand 1. The automatic sewing unit described as far as that is illustrated and described in detail in U.S. Ser. No. 07/785 503, to which reference is made to.

At the stand 1 a zip-fastener feeding device 11 is disposed. It is secured to one end of a supporting arm 12, which is arranged transversely to the main direction of the sewing machine 2, i.e. in x-direction. The other end of the supporting arm 12 is tiltably supported by means of a shaft 14 in a bearing 13 which is disposed on the stand 1. Tilting is performed by means of a tilting drive 15, which is formed as a double-acting pneumatically actuatable piston cylinder drive. Its piston rod 16 is articulated on a tilting lever 17 which is non-rotatably connected with the shaft 14. Its cylinder 18 is articulated on an abutment 19 which is disposed on the stand 1. In FIG. 1 the supporting arm 12 with the feeding device 11 is illustrated in solid lines in its position running parallel to the workpiece retaining plate 9 and in dot-dash lines in its position tilted upwards. In this position tilted upwards the piston 20 of the tilting drive 15 with the piston rod 16 is in the position in which it is moved into the cylinder 18, as can be seen from FIG. 1. In the supporting arm 12 a drive motor 21 with a gear unit 22 is arranged, the driven shaft 23 of which serves for driving the feeding device 11. The driven shaft 23 is supported in a bearing bush 24, which is supported in the box-type supporting arm 12 by means of a holding 25. The drive motor 21 with gear unit 22 can be arranged in an extension of the supporting arm 12, which is consequently arranged—in FIG. 1 on the right—on the other side of the shaft 14. By means of this the drive motor 21 with gear unit 22 could serve as a counterweight for the feeding device 11.

Figure 2:
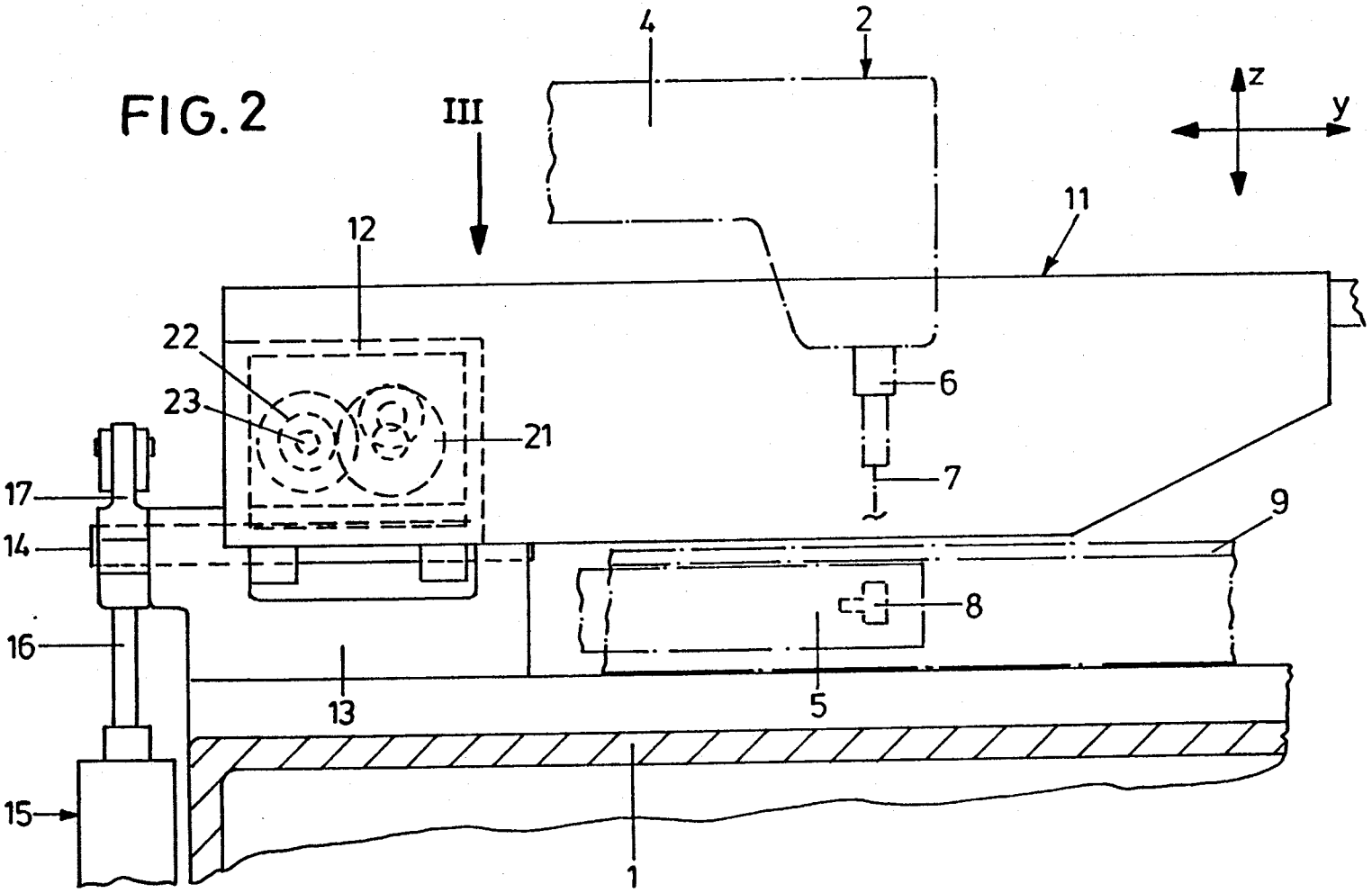
FIG. 2 shows a partial side view of the automatic sewing unit in accordance with the arrow II in FIG. 1.
Figure 3:
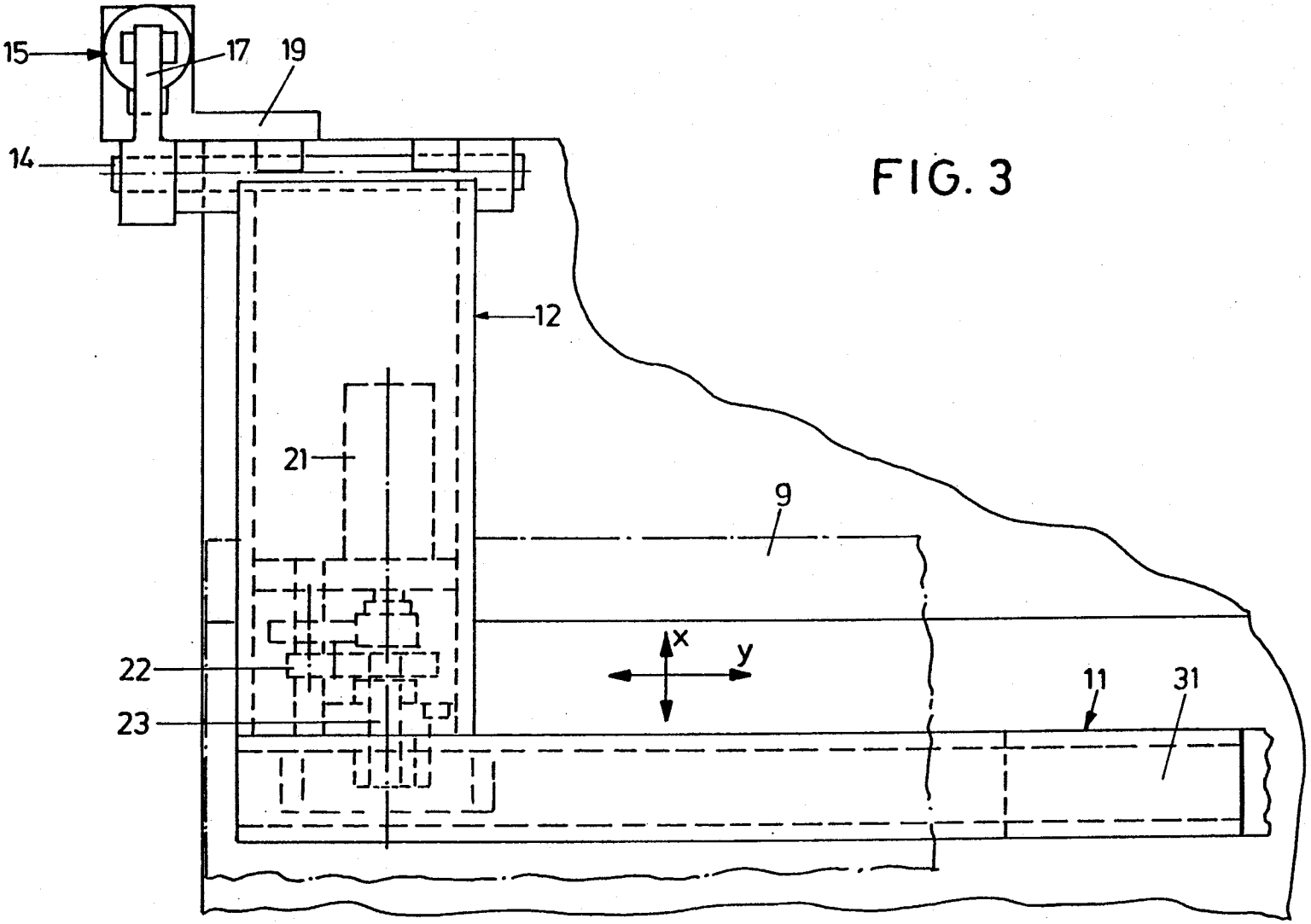
FIG. 3 shows a partial plan view onto the automatic sewing unit in accordance with the arrow III in FIG. 2.

The sewing machine 2 is shown only in dot-dash lines in FIGS. 1 and 2, since during operation it cannot be located at the same time with the feeding device 11 in the position shown in the drawing.

As can be seen from FIGS. 4 to 7, the zip-fastener feeding device 11 is formed in the shape of a box. It has a side wall which is substantially vertically aligned and which serves as a base plate 26, at which side wall a cover plate 27 extending substantially horizontally and a front plate 28 extending substantially vertically are disposed. At the cover plate 27 and at the front plate 28 a cover 29, which is also formed as a vertical side wall, is removably secured by means of screws 30. The cover 29 extends parallel to the base plate 26. At the lower side facing the workpiece retaining plate 9 the box-type housing 31, which is formed by the base plate 26, the cover plate 27, the front plate 28 and the cover 29, is provided with an opening 32 serving as an output section for a zip fastener. At the front side located oppositely to the front plate 28 the housing 31 is largely closed by an introduction funnel 33 serving as an introduction device, which is secured removably and replaceably by means of screws 34. At the transition from the opening 32 to the introduction funnel 33 the housing 31 is further closed downwardly by a wall 35.

In the housing 31 a drive wheel 36, a deflection pulley 37, a tensioning pulley 38 associated to the latter and a further deflection pulley 39 are rotatably supported, around which two round belts 40, 41 made of plastics material are guided as drawing means for a zip fastener to be fed.

The drive wheel 36 is supported in the vicinity of the front plate 28 and is directly coupled with the driven shaft 23. It is consequently located in the area in which the housing 31 is disposed at the supporting arm 12. The drive wheel 36 is located above the opening 32 in like manner. This applies also to the deflection pulley 37 which is arranged behind the drive wheel 36 in the transport direction 42 of the round belts 40, 41. Above from the deflection pulley 37 the tensioning pulley 38 is displaceably guided and secured in an oblong hole 43 in the base plate 26. To this effect a bolt 44 bearing the tensioning pulley 38 is arranged displaceably and fixably in the oblong hole 43 by means of a fastening nut 45. The tensioning pulley 38 is supported freely rotatable on the bolt 44 by means of a rolling bearing 46.

The further deflection pulley 39 is supported freely rotatable at the base plate 26—in the transport direction 42 behind the tensioning pulley 38—in the area of the introduction funnel 33. The two deflection pulleys 37, 39 are secured in like manner as the tensioning pulley 38 in the base plate 26 each by means of a bolt with fastening nuts—however stationary, however only the bolt 49 with fastening nut 50 of the deflection pulley 37 being illustrated. They are also formed freely rotatable. On their circumference the drive wheel 36, the deflection pulley 37, the tensioning pulley 38 and the deflection pulley 39 each have guiding grooves 47, 48 for the round belts 40, 41, so that these are guided precisely parallel to each other on the drive wheel 36 and the pulleys 37, 38, 39.

Between the deflection pulley 39 and the drive wheel 36 an upper supporting rail 51 is disposed at the base plate 26 by means of screws 52, on which base plate 26 the round belts 40, 41 are supportably guided so that they cannot move away downwardly. A comparable—shorter—lower supporting rail 53 is arranged above from the opening 32 between the drive wheel 36 and the lower deflection pulley 37 and is also secured to the base plate 26 by means of screws 54, against which the round belts 40, 41 support upwardly, so that they cannot move away upwardly.

Above from the upper supporting rail 51, i.e. between the latter and the cover plate 27 a presser bar 55 is arranged extending from the deflection pulley 39 to the drive wheel 36. The presser bar 55 is secured by means of leaf springs 56 at the cover plate 27, for example by means of screws 57. By means of this presser bar 55 a zip fastener introduced through the introduction funnel 33 is elastically pressed against the round belts 40, 41, which in turn support against the upper supporting rail 51. To this effect the introduction funnel 33 has a lower introduction surface 58, which guides a zip fastener of this type onto the round belts 40, 41 located on the deflection pulley 39. It has furthermore an upper introduction surface 59 located above the lower introduction surface 58, which assures that a zip fastener of this type is guided below the presser bar 55. The introduction funnel 33 has furthermore lateral introduction surfaces 60, 61 between the introduction surfaces 58, 59, by means of which a zip fastener of this type is put onto the round belts 40, 41 in the correct lateral position in relation to the round belts 40, 41.

On the side facing the front plate 28, i.e. in the area in which the round belts 40, 41 surround the drive wheel 36, a guiding device 62 is arranged. This guiding device 62 has substantially two guide rails 63, 64 and an inner guiding sheet 65 and an outer guiding sheet 66, which are arranged concentrically to the rotational axis 67 of the drive wheel 36. The guide rails 63, 64 are disposed laterally beside the drive wheel 36. As can be seen from FIG. 5, the guide rail 63 is secured to the base plate 26 by means of screws 68. The other guide rail 64 is disposed in appropriate manner, e.g. by soldering, at the cover 29. The guiding surfaces 69, 70 of the guide rails 63, 64 extend approximately in alignment with the round belts 40, 41, as can be seen from FIGS. 5 and 6.

The two guiding sheets 65, 66 are disposed at a supporting plate 71, which is secured to the base plate 26 by means of screws 72. The inner guiding sheet 65 extends—in the direction of the rotational axis 67—from the base plate 26 beyond the round belt 40 which is adjacent to the base plate 26. The inner guiding sheet 65 defines together with the guide rail 63 which is arranged within the inner guiding sheet 65 an inner guiding channel 73.

The outer guiding sheet 66 extends in the direction of the rotational axis 67 beyond the guide rail 64 associated to the cover 29. Between the inner guiding sheet 65 and the outer guiding sheet 66 an outer guiding channel 74 is defined.

Figure 4:
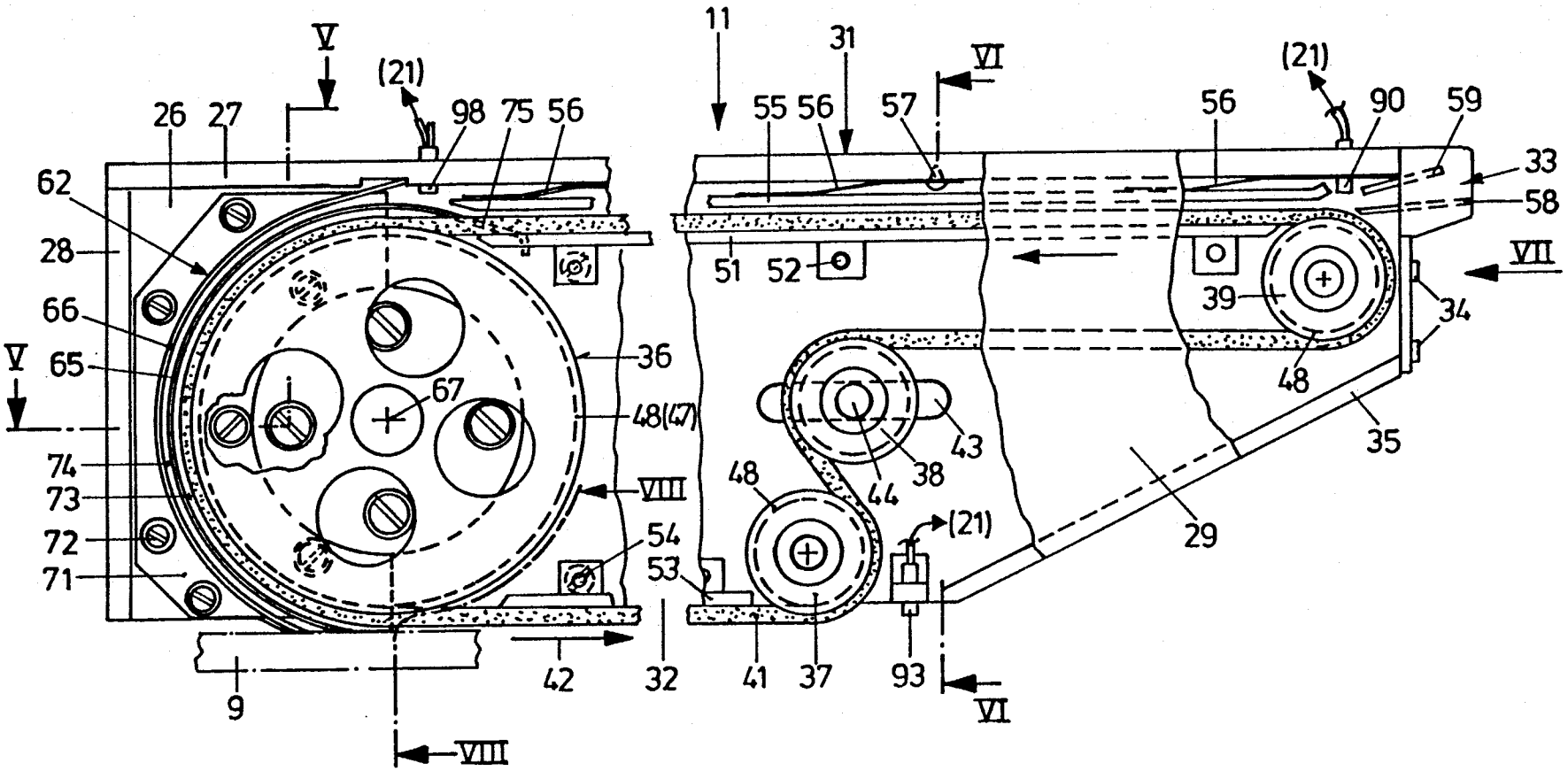
FIG. 4 shows a side view of the zip-fastener feeding device in accordance with the arrow IV in FIG. 1 in a substantially cut-away representation.
Figure 5:
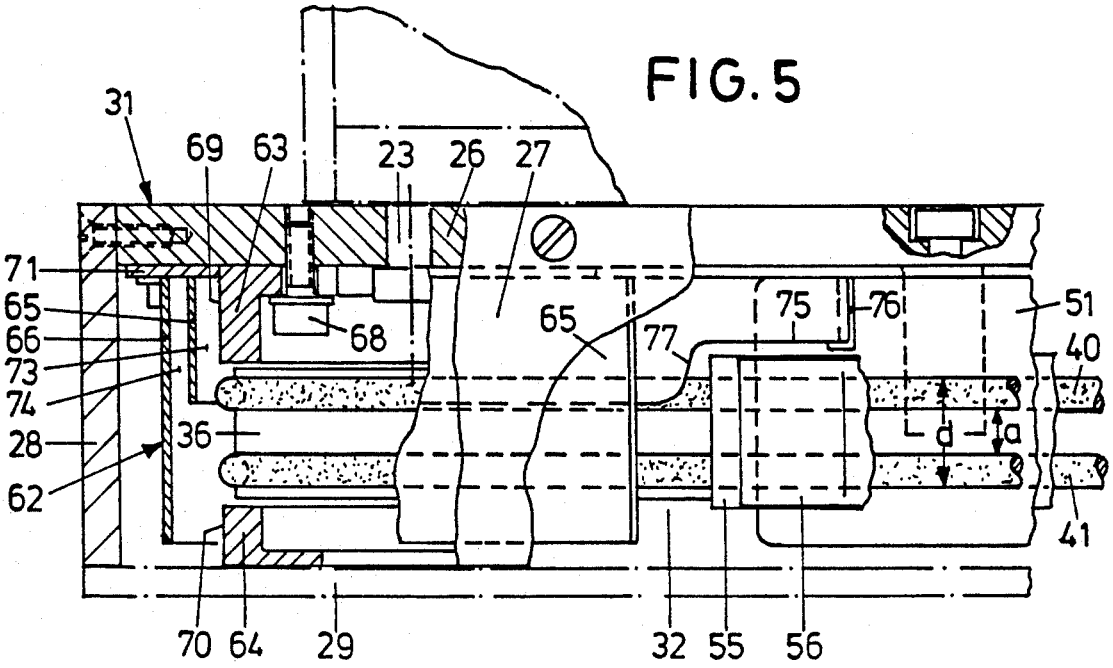
FIG. 5 shows a part section through the zip-fastener feeding device in accordance with the line V—V in FIG. 4.
Figure 6:
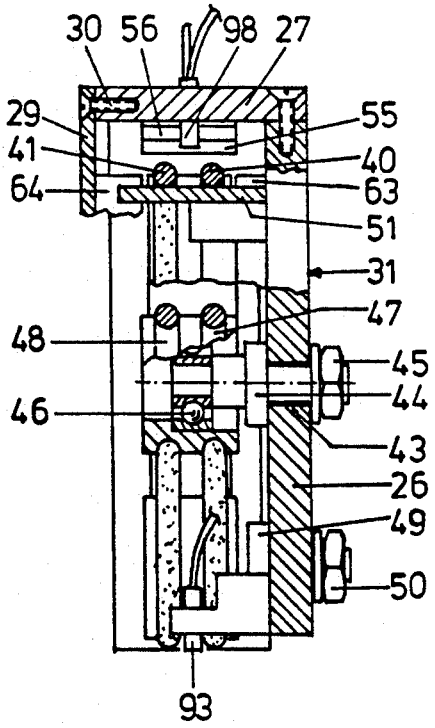
FIG. 6 shows a sectional illustration of the zip-fastener feeding device in accordance with the line VI—VI in FIG. 4.
Figure 7:
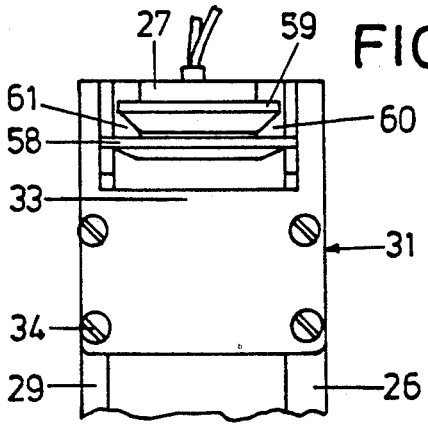
FIG. 7 shows a side view of the zip-fastener feeding device in accordance with the arrow VII in FIG. 4.
Figure 12:
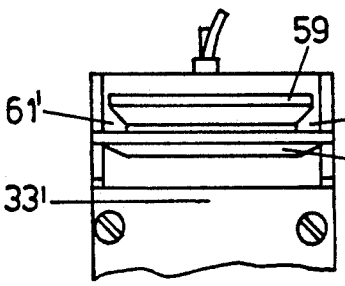
FIG. 12 shows a view corresponding to FIG. 7, the introduction funnel for a zip fastener being embodied with sewn on covering strip.

As can be seen from FIG. 4 and in particular from FIG. 5, the inner guiding sheet 65 has a deflector 75 on its side facing the upper supporting rail 51, i.e.—related to the transport direction 42—in the end of the entry side of the guiding channels 73, 74, which deflector 75 is guided between the base plate 26 and the round belt 40 facing the latter approximately down to the upper supporting rail 51. To this effect a recess 76 adapted to the deflector 75 is formed in the upper supporting rail 51. Between the wider inner guiding sheet 65 and the smaller deflector 75 a transition 77 is provided approximately flush with the accociated end of the upper supporting rail 51.

A zip-fastener retainer 10 formed in the workpiece retaining plate 9 is shown in FIGS. 8 and 9. The workpiece retaining plate 9 is made in sandwich construction, i.e. it has an upper plate 78, a lower plate 79 and a spacing plate 80 spacing the two apart. The spacing plate 80 is firmly connected with the upper plate 78 and the lower plate 79, for instance by adhesion. The zip-fastener retainer 10 is formed in the workpiece retaining plate 9 in the form of an oblong opening into which a zip fastener 81 can be introduced through a zip-fastener inlet 82 in y-direction. On both sides of the zip-fastener retainer 10 retainers 83, 84 are formed for the halves 85, 86 of the zip fastener 81, as can be seen in particular from FIG. 8. This means that the spacing plate 80 has approximately the thickness of the halves 85, 86 of a zip fastener 81, so that the latter is held in the zip-fastener retainer 10 in a drawn-in position.

Furthermore a supporting slider 87 is arranged below the lower plate 79 and resting against it, which supporting slider 87 is displaceable in x-direction by means of a supporting slider drive not shown. It has a free edge 88 which is bent downwards. The embodiment of the workpiece retaining plate 9 and of the zip-fastener retainer 10 including the supporting slider 87 is illustrated and described in detail in U.S. Pat. Ser. No. 07/785,503, to which reference is made.

With the embodiment according to FIGS. 8 to 10 the zip-fastener inlet 82 is formed by a recess 89, which extends only through the upper plate 78 and the spacing plate 80, whereas the lower plate 79 is closed in this area. As can be seen from FIG. 10, the inner guiding sheet 65 and the outer guiding sheet 66 are formed such that they are elastically placed on the lower plate 79. The guide rail 63 ends in flush manner with the upper plate 78. From the foregoing follows that the inner guiding channel 73 passes into the retainer 83 or 84 of the zip-fastener retainer 10.

The feeding of a simple zip fastener 81 is made as follows:

A zip fastener 81 is introduced through the introduction funnel 33, the lateral alignment being performed by the lateral introduction surfaces 60, 61. The edge 81*a* of the zip fastener 81 advancing in transport direction 42 is detected by an optical sensor 90 which is arranged between the introduction funnel 33 and the presser bar 55 above from the deflection pulley 39, by means of which the drive motor 21 is switched on. The zip fastener 81 is drawn in between the presser bar 55 and the round belts 40, 41, the latter serving as drawing means. In this case the zip-fastener feeding device 11 is in its position in which it is tilted down to the workpiece retaining plate 9, in which consequently the sewing machine 2 is in a position moved out of this area. The introduction of the zip fastener 81 is performed in a manner in which its upper side faces downwards. Its teeth 91 are located between the round belts 40, 41. Thus the clearance a of the round belts 40, 41 is larger than the width b of the teeth 91 and smaller than the width c of the zip fastener 81, so that the round belts 40, 41 rest reliably against the halves 85, 86. The zip fastener 81 may already comprise a slider 92; however, this need not be the case. The one half 85 of the zip fastener 81 is drawn into the inner guiding channel 73, at least the one half 85 of the zip fastener 81 being pressed by the inner guiding sheet 65 onto the round belt 40 which is covered by the inner guiding sheet 65. As the inner guiding channel 73 passes into the retainer 83, and as also the half 86 is guided on the guide rail 64, both halves 85, 86 are pushed from the zip-fastener inlet 82 into the retainers 83, 84 of the zip-fastener retainer 10. When pushing the zip fastener 81 into the retainers 83 and 84, the round belts 40, 41 rest on the one hand against the halves 85 or 86 and on the other hand against the lower supporting rail 53. The outer distance d of the round belts 40, 41 is thus smaller than the clearance e of the retainers 83, 84. The complete pushing-in of the zip fastener 81 into the zip-fastener retainer 10 is detected by means of an optical sensor 93, which is arranged directly behind the deflection pulley 37 in transport direction 42, and which detects the advancing edge 81*a*. This optical sensor 93 switches off the drive motor 21, when the zip fastener 81 has reached its end position in the zip-fastener retainer 10. In case the drive motor 21 should trail, this would not be significant, as the round belts 40, 41 would slip through in this case on the halves 85, 86, if—as is outlined in FIG. 9—the zip-fastener retainer 10 has an end stop 10*a*, on which the advancing edge 81 will rest. When drawing in the zip fastener 81 into the zip-fastener retainer 10 the supporting slider 87 has moved to the position shown in FIG. 8 in dot-dash lines. As an alternative to switching off the drive motor 21, the tilting drive 15 can also be activated, so that the feeding device 11 is tilted upwards, by means of which also the round belts 40, 41 come out of contact.

The feeding and introduction of a zip fastener 81 provided with a socalled fly placket, i.e. a lower covering strip 94, can be seen from FIGS. 11 to 16. A zip-fastener 81 of this type with a lower covering strip 94 is shown in FIG. 11. In this case the one half 86 is already sewn together with the lower covering strip 94 by means of a seam 95. As can be seen from FIG. 12, in this case the introduction funnel 33' is embodied in a wider manner, i.e. the lateral introduction surfaces 60', 61' are staggered such that the zip fastener 81 is introduced in like manner as in the case already described. This means that the teeth 91 are introduced between the round belts 40, 41; the covering strip 94 which protrudes laterally—and that in particular in direction towards the base plate 26—is also introduced.

As the lower covering strip 94 protrudes with its one edge 96 beyond the half 85 of the zip fastener 81 towards the base plate 26, this edge 96 runs onto the deflector 75 directly before reaching the drive wheel 36 and is guided by this effect in the outer guiding channel 74, while the zip fastener 81 is guided in the above-described manner in the inner guiding channel 73.

Figure 13:
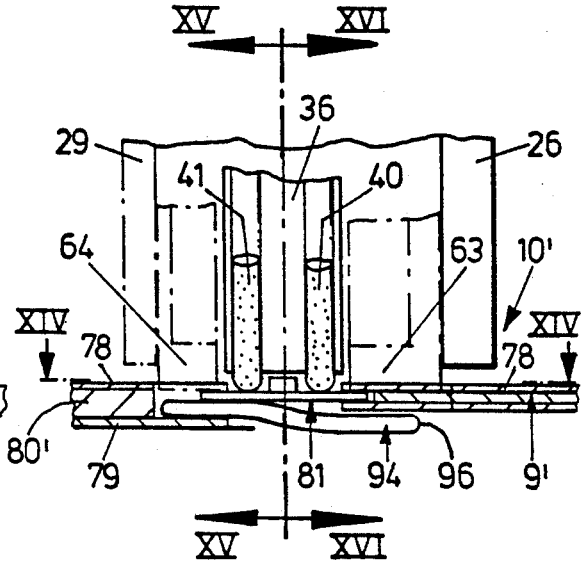
FIG. 13 shows a view corresponding to FIG. 8, a zip-fastener retainer being illustrated for a zip fastener with sewn on covering strip.
Figure 15:
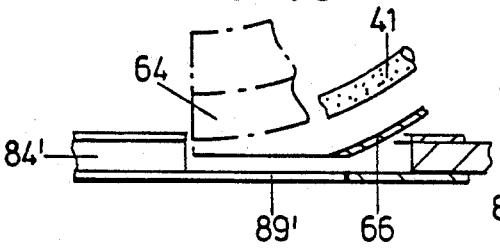
FIG. 15 shows a vertical part section through FIG. 13 along the line XV—XV and FIG. 16 shows a vertical section through FIG. 13 along the line XVI—XVI in FIG. 13.
Figure 14:
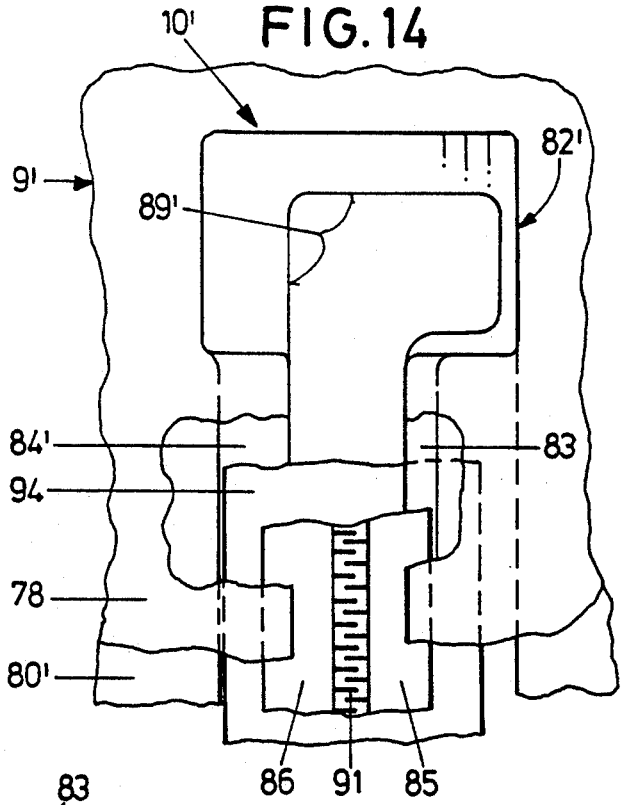
FIG. 14 shows a plan view onto the zip-fastener retainer along the line XIV—XIV in FIG. 13.
Figure 16:
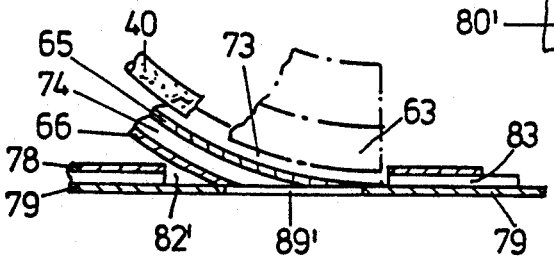

In this embodiment the workpiece retaining plate 9' has a zip-fastener inlet 82', which is formed by a recess 89' passing through the upper plate 78 and the lower plate 79 and the spacing plate 80. Whereas the retainer 83 for the half 85 is embodied as in the above described example of embodiment, the retainer 84' is embodied as high as that the lower covering strip 94 and the half 86 of the zip fastener 81 have room therein. Thus the spacing plate 80' is formed in a correspondingly thicker manner in this area. When the zip fastener 81 together with the covering strip 94 arrives with the advancing end 97 of the covering strip 94 shown on below in FIG. 11 at the zip-fastener inlet 82, then the half 86 and the part of the lower covering strip 94 sewn together with the half 86, which were guided between the outer guiding sheet 66 and the guide rail 64, are introduced into the retainer 84', as is illustrated in FIG. 13 on the left and in FIG. 15. The half 85 of the zip fastener 81 advanced in the inner guiding channel 73 is—as described already above—introduced into the retainer 83. Simultaneously the edge 96 of the lower covering strip 94 which is advanced in the outer guiding channel 74 is pushed through the recess 89' of the zip-fastener inlet 82' and arrives below the lower plate 79. It can then be folded over for the purpose of sewing the zip fastener 81 by means of the free edge 88 of the supporting slider 87.

In the feeding device 11 a third optical sensor 98 is provided—related to the transport direction 42—directly before the drive wheel 36, by means of which optical sensor 98 it is verified on the one hand, whether a material jam has occurred in this area, when introducing a zip fastener 81 with or without a lower covering strip 94. Furthermore this optical sensor can also be used to measure the length of the zip fastener 81, which can be computed by the optical sensor 98 with a constant feeding speed from the time between the detection of the advancing edge 81*a* and the following edge 81*b* of the zip fastener 81.

After the introduction of a zip fastener 81 with or without a covering strip 94 into a zip-fastener retainer 10 or 10' the zip-fastener feeding device 11 is tilted upwards into the position shown in dot-dash lines in FIG. 1, so that the sewing machine 2 is not impeded during the subsequent sewing of a part of workpiece, which is to be put onto the workpiece-retaining plate 9 or 9', with the zip fastener 81.

What is claimed is:

1. A zip-fastener feeding device for an automatic sewing machine with a workpiece retaining plate (9, 9') comprising:

an introduction device (33, 33') for introducing said zip fastener (81) into said device;

an output section (32) for outputting said zip fastener (81);

an endless drawing means for drawing said zip fastener (81) drivable in a transport direction (42) and extending from said introduction device (33, 33') downstream to said output section (32);

a controllable drive (21) for driving said drawing means; and a detection device (93) associated to said output section (32) for detecting an end position of said zip fastener (81) and stopping a function of said drawing means.

2. The zip-fastener feeding device according to claim 1, wherein said introduction device comprises lateral introduction surfaces (60, 61, 60').

3. The zip-fastener feeding device according to claim 1, wherein at least one drive wheel (36) and deflection pulley (37, 39) guide said drawing means said at least one drive wheel (36) being coupled with said controllable drive (21), and said deflection pulley (37, 39) is freely rotatable.

4. The zip-fastener feeding device according to claim 1, wherein a detection device (90) is provided for detecting said zip fastener (81) and actuating a function of said controllable drive (21) said detection device is associated to said introduction device (33, 33').

5. A zip-fastener feeding device for an automatic sewing machine with a workpiece retaining plate (9, 9') comprising:

an introduction device (33, 33') for introducing said zip fastener (81) into said device;

an endless drawing means for drawing said zip fastener (81) drivable in a transport direction (42);

a controllable drive (21) for driving said drawing means;

an output section (32) for outputting said zip fastener (81); and a detection device (93) associated to said output section (32) for detecting an end position of said zip fastener (81) and stopping a function of said drawing means, wherein said drawing means comprises two endless belts (40,41) positioned parallel and at a distance (a) to each other.

6. The zip-fastener feeding device according to claim 5, wherein at least one drive wheel (36) and deflection pulley (37, 39) guide said drawing means said at least one drive wheel being coupled with said controllable drive (21), and said deflection pulley (37, 39) is freely rotatable.

7. The zip-fastener feeding device according to claim 5, wherein said drawing means is supported transversely to said transport direction (42) between said introduction device (33, 33') and said output section (32) by at least one supporting rail (51, 53).

8. The zip-fastener feeding device according to claim 7, wherein said at least one supporting rail (53) for said drawing means is provided above said output section (32).

9. The zip-fastener feeding device according to claim 5, wherein a presser bar (55) is provided in the transport direction (42) downstream said introduction device (33, 33') and upstream said output section (32), said presser bar (55) presses said zip fastener (81) against said drawing means.

10. (Amended) A zip-fastener feeding device for an automatic sewing machine with a workpiece retaining plate (9, 9') comprising;

an introduction device (33, 33') for introducing said zip fastener (81) into said device;

an endless drawing means for drawing said zip fastener (81) drivable in a transport direction (42);

a controllable drive (21) for driving said drawing means;

an output section (32) for outputting said zip fastener (81); and a detection device (93) associated to said output section (32) for detecting an end position of said zip fastener (81) and stopping a function of said drawing means, wherein said drawing means is supported transversely to said transport direction (42) between said introduction device (33, 33') and said output section (32) by at least one supporting rail (51, 53).

11. The zip-fastener feeding device according to claim 10, wherein said at least one supporting rail (53) for said drawing means is provided above said output section (32).

12. The zip-fastener feeding device according to claim 10, wherein said drawing means comprises two endless belts (40, 41) positioned parallel and at a distance (a) to each other.

13. A zip-fastener feeding device for an automatic sewing machine with a workpiece retaining plate (9, 9') comprising:

an introduction device (33, 33') for introducing said zip fastener (81) into said device;

an endless drawing means for drawing said zip fastener (81) drivable in a transport direction (42);

a controllable drive (21) for driving said drawing means;

an output section (32) for outputting said zip fastener (81); and a detection device (93) associated to said output section (32) for detecting an end position of said zip fastener (81) and stopping a function of said drawing means, wherein a presser bar (55) is provided in the transport direction (42) downstream said introduction device (33, 33') and upstream said output section (32), said presser bar (55) presses said zip fastener (81) against said drawing means.

14. A zip-fastener feeding device for an automatic sewing machine with a workpiece retaining plate (9, 9') comprising;

an introduction device (33, 33') for introducing said zip fastener (81) into said device;

an endless drawing means for drawing said zip fastener (81) drivable in a transport direction (42);

a controllable drive (21) for driving said drawing means;

an output section (32) for outputting said zip fastener (81); and a detection device (93) associated to said output section (32) for detecting an end position of said zip fastener (81) and stopping a function of said drawing means, wherein a guiding device (62) is located upstream said output section (32), said guiding device (62) comprises a first guiding channel (73) guiding said zip fastener (81), said drawing means protrudes at least partially into said first guiding channel, and said channel opens towards said output section (32).

15. The zip-fastener feeding device according to claim 14, wherein said first guiding channel (73) is defined by guide rails (63, 64) positioned laterally of said drawing means and by a first guiding sheet (65) located oppositely to at least one of said guide rails (63).

16. The zip-fastener feeding device according to claim 15, wherein said guiding device (62) comprises a second guiding channel (74) facing away from said drawing means and wherein a deflector (75) is provided on one side of said drawing means said deflector guides into said second guiding channel (74), and wherein said second guiding channel (74) is defined by said first guiding sheet (65) defining said first guiding channel (73) and by a second guiding sheet (66).

17. The zip-fastener feeding device according to claim 14, wherein said guiding device (62) comprises a second guiding channel (74) facing away from said drawing means and wherein a deflector (75) is provided on one side of said drawing means and said deflector guides into said second guiding channel (74).

18. A zip-fastener feeding device for an automatic sewing machine with a workpiece retaining plate (9, 9') comprising;

an introduction device (33, 33') for introducing said zip fastener (81) into said device;

an endless drawing means for drawing said zip fastener (81) drivable in a transport direction (42);

a controllable drive (21) for driving said drawing means;

an output section (32) for outputting said zip fastener (81); and a detection device (93) associated to said output section (32) for detecting an end position of said zip fastener (81) and stopping a function of said drawing means, wherein a tilting drive (15) is provided for tilting said feeding device, and said feeding device (15) supported by a bearing (13).

* * * * *